US006880199B1

(12) United States Patent
Huffman et al.

(10) Patent No.: US 6,880,199 B1
(45) Date of Patent: Apr. 19, 2005

(54) EXTRACTION CLEANING WITH COLLAPSIBLE TANKS

(75) Inventors: Eric C. Huffman, Lowell, MI (US); Thomas K. Ankney, East Grand Rapids, MI (US); Jonathan L. Miner, Rockford, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 381 days.

(21) Appl. No.: 10/065,255

(22) Filed: Sep. 30, 2002

Related U.S. Application Data

(60) Provisional application No. 60/326,322, filed on Oct. 1, 2001.

(51) Int. Cl.[7] ..... A47L 11/30
(52) U.S. Cl. ..... 15/320
(58) Field of Search ..... 15/320, 321, 353

(56) References Cited

U.S. PATENT DOCUMENTS 3,426,381 A * 2/1969 Segesman ..... 15/353
3,491,398 A 1/1970 Segesman
4,156,952 A 6/1979 Lynch, Jr.
4,741,069 A * 5/1988 Helm et al. ..... 15/320
5,526,547 A * 6/1996 Williams et al. ..... 15/320
5,735,017 A 4/1998 Barnes et al.
5,761,763 A 6/1998 McAllise et al.
5,839,159 A 11/1998 Karr et al.
5,983,448 A * 11/1999 Wright et al. ..... 15/365
6,073,300 A 6/2000 Zahuranec et al.
6,158,081 A 12/2000 Kasen et al.
2002/0116783 A1 * 8/2002 Giddings et al. ..... 15/321
2003/0070249 A1 * 4/2003 Lehman et al. ..... 15/320

* cited by examiner

*Primary Examiner*—Terrence R. Till
(74) *Attorney, Agent, or Firm*—McGarry Bair PC

(57) ABSTRACT

An upright extraction cleaning machine comprises a base module, an upright handle pivotally mounted to the base module, a cleaning solution dispensing system for depositing a cleaning solution on a surface to be cleaned, and a fluid recovery system for recovering expended cleaning solution from the surface to be cleaned. The cleaning solution dispensing system includes at least one tank for holding solution to be dispensed and the recovery system includes a tank for holding recovered solution. Each of the tanks comprises a flexible bladder that is collapsible when empty and will expand as it is filled by the respective fluid. In one embodiment, the upright extraction cleaning machine further comprises additional tanks for holding detergent and carpet treatment to be dispensed. In a further embodiment, the additional tanks for detergent and carpet treatment each comprise a flexible bladder.

34 Claims, 11 Drawing Sheets

EXTRACTION CLEANING WITH COLLAPSIBLE TANKS

CROSS REFERENCE TO RELATED APPLICATIONS

This application claims the benefit of U.S. Provisional Application No. 60/326,322, filed on Oct. 1, 2001.

BACKGROUND OF INVENTION

1. Field of the Invention

The invention relates to an upright extraction cleaning machine incorporating a flexible tank for holding a liquid. In one of its aspects, the invention relates to an upright extraction cleaning machine incorporating multiple collapsible or flexible tanks for holding clean water, dirty water, detergent, oxidizing solution and carpet protectant.

2. Description of the Related Art

An upright extraction cleaning machine incorporating a single flexible bladder for holding clean water in a rigid recovery tank is disclosed in U.S. Pat. No. 6,230,362. Other prior art references that disclose extraction cleaning machines with a flexible bladder forming a clean water tank or a recovery tank in a rigid recovery tank or clean water tank, respectively, include the U.S. Pat. No. 4,156,952 to Lynch, Jr., U.S. Pat. No. 5,735,017 to Barnes et al., U.S. Pat. No. 3,426,381 to Segesman and U.S. Pat. No. 3,491,398 to Segesman.

SUMMARY OF INVENTION

According to the invention, an extraction cleaning machine comprises a housing, a cleaning solution dispensing system mounted to the housing for depositing a cleaning solution on a surface to be cleaned, and a fluid recovery system mounted to the housing for recovering expended cleaning solution from the surface to be cleaned. The dispensing system includes a dispensing tank for holding solution to be dispensed. The recovery system also includes a recovery tank for recovered solution. The recovery tank is flexible to expand as recovered fluid is received therein. The dispensing tank comprises a flexible bladder that is collapsible as cleaning fluid is dispensed therefrom. The dispensing tank and the recovery tank are adjacent to one another in a common space and positioned so that the dispensing tank collapses as the recovery tank expands.

In one embodiment, the cleaning solution dispensing system further comprises additional tanks for detergent and carpet treatment. Preferably, the additional tanks for detergent and carpet treatment each comprise a flexible bladder that collapses as solution therein is dispensed therefrom.

In a further embodiment, the tanks are mounted in a confined shell in the housing. In one embodiment, the tanks are both located in a base module of an upright deep cleaner. In another embodiment the tanks are both located in an upright handle in an upright deep cleaner.

The tanks can be arranged side by side in horizontal alignment or in vertically stacked alignment.

DETAILED DESCRIPTION

Figure 1:
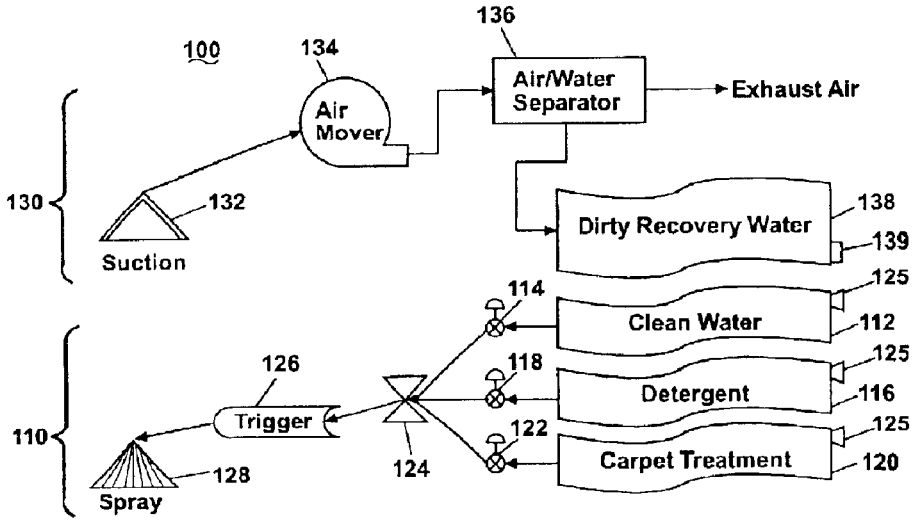
FIG. 1 is a schematic representation of the extraction cleaning system incorporating flexible tanks according to the invention.

Referring now to FIG. 1, the extraction cleaning system 100 according to the invention includes a cleaning solution dispensing system 110 and a fluid recovery system 130 incorporating multiple flexible tanks.

The cleaning solution dispensing system 110 includes at least one and preferably a plurality of flexible supply tanks or bladders 112, 116, 120 for holding any of the number of desired fluids for dispensing onto a surface to be cleaned. The fluids can include water or other cleaning or protecting agents such as detergent, anti-allergens, carpet protectant, an oxidizing solution and other commonly known carpet and upholstery treatment solutions.

Each of the supply tanks or bladders 112, 116, 120 is fluidly connected to a solution pump 124 through respective adjustable valves 114, 118 and 122. The pump 124 is further fluidly connected to a dispensing nozzle 128 through an actuation trigger valve 126.

Upon actuation of the trigger 126, the fluids released to the pump 124 by the valves 114, 118, 122 are sprayed onto the surface being cleaned through the dispensing nozzle 128. As the various fluids are dispensed, the supply tanks 112, 116, 120 will tend to collapse. The volume occupied by the supply tanks 112, 116, 120 will tend to decrease in proportion to the decrease in the volume of fluid in the tanks. Each of the supply tanks 112, 116 and 120 has an opening 125, typically, covered by a cap for filling the tanks.

The fluid recovery system 130 shown in FIG. 1 is commonly known as a "dirty air system" in that the fluid passing through a suction source 134 such as an impeller has not previously passed through any filtering or separation system to remove contaminants. A suction nozzle 132 is placed proximate to a surface being cleaned and a suction force is applied to draw liquid and debris from the surface. In the depicted fluid recovery system 130, the suction nozzle 132 is fluidly connected to the intake of a suction source 134. The output of the suction source 134 is fluidly connected to an air/liquid separator 136. The air/liquid separator 136 provides a means whereby a liquid such as a dirty cleaning solution, including any particulate matter drawn through the suction nozzle 132, is separated from an exhaust air flow. The exhaust air flow is then released to atmosphere. The air/liquid separator 136 can be, but need not be, the separator disclosed in U.S. Pat. No. 6,167,586.

The liquid separated from the exhaust air flow is retained in a flexible recovery tank or bladder 138. The recovery tank 138 can be fluidly connected to a separately formed air/liquid separator 136, or, in some embodiments, the recovery tank 138 and air/liquid separator 136 can be integrally formed with the recovery tank. Typically, the recovery tank can have a removable drain plug 139 for draining the tank.

As the fluid recovery system 130 draws dirty solution from a surface being cleaned, the liquid separated from the air flow is deposited in the recovery tank 138. The flexible recovery tank 138 will increase in volume in proportion to the volume of liquid deposited therein. The volume of liquid deposited in the recovery tank 138 will be equal to or less than the volume of liquid dispensed by the solution tanks 112, 116, 120. Some volume of the liquid dispensed generally remains on the surface being cleaned or evaporates. The recovery tank is preferably biased into the expanded condition. In one embodiment, the natural resilience of the material that forms the recovery tank 138 biases the recovery tank into the expanded condition. In another embodiment, a spring can be placed inside the recovery tank to bias the recovery tank into the expanded condition.

In the extraction cleaning system 100 of FIG. 1, the recovery tank 138 is located with the solution tanks 112, 116, 120 on the same portion of the extraction cleaner. In the preferred embodiment, a rigid housing contains the recovery tank 138 and solution tanks 112, 116, 120. The housing is sized to hold an empty recovery tank 138 and full solution tanks 112, 116, 120, and vice versa. As liquid is dispensed from the solution tanks 112, 116, 120, the size of the tanks 112, 116, 120 will decrease sufficiently for recovery tank 138 to expand into the space vacated by the tanks 112, 116, 120 as recovered liquid is deposited in the recovery tank 138. The housing can thus be much smaller than the combined full volume of the recovery tank 138 and the solution tanks 112, 116, 120. In an alternative embodiment (not shown) one or more of the solution tanks is mounted in a second housing.

Figure 2:
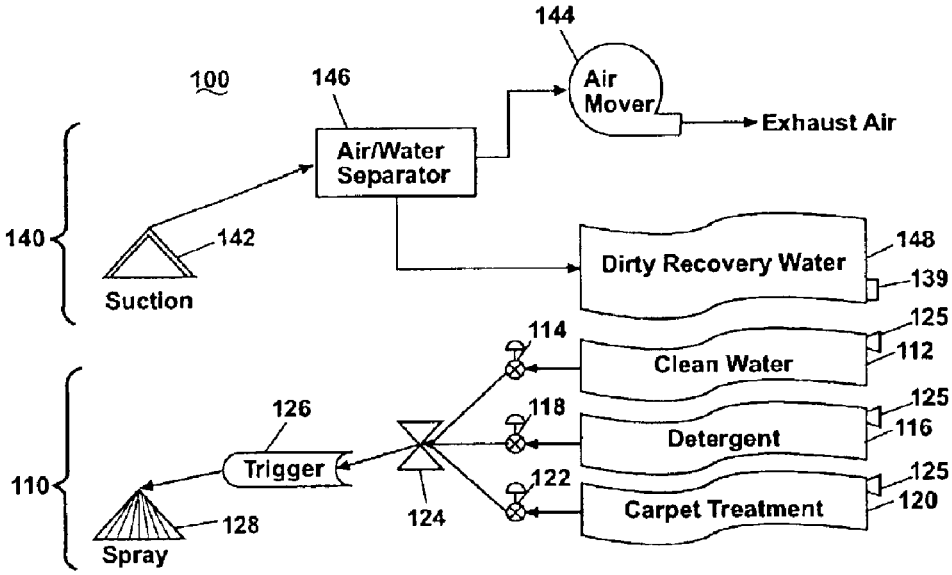
FIG. 2 is a schematic representation of a further embodiment of an extraction cleaning system incorporating flexible tanks according to the invention.

Referring now to FIG. 2 in which like numerals have been used to designate like parts, a "clean air" extraction cleaning system 100 comprises a solution dispensing system 110 and a recovery system 140. The solution dispensing system 110 is the same as disclosed with respect to the "dirty air" system of FIG. 1. The recovery system 140 differs in the arrangement of elements in the flow path of the recovered fluid.

A suction nozzle 142 placed proximate to a surface to be cleaned is fluidly connected to an air/liquid separator 146. The air/liquid separator 146 is further fluidly connected to a suction source 144 and to a flexible recovery tank or bladder 148. An exhaust of the suction source 144 is vented to the atmosphere.

As recovered fluid is drawn through the suction nozzle 142 and into the air/liquid separator 146, liquid contained in the recovered fluid is separated from the air and deposited into the recovery tank 148. The air, now substantially devoid of liquid, is drawn to the suction source 144 and exhausted to atmosphere.

As discussed with respect to the extraction cleaning system 100 of FIG. 1, the air/liquid separator 146 and recovery tank 148 can be integrally or separately formed. Further, the recovery tank 148 is located in the same confined space with the solution tanks 112, 116, 120 and, expands as it fills with recovered liquid to occupy the space vacated by the solution tanks as solution is dispensed onto the surface being cleaned.

Figure 3:
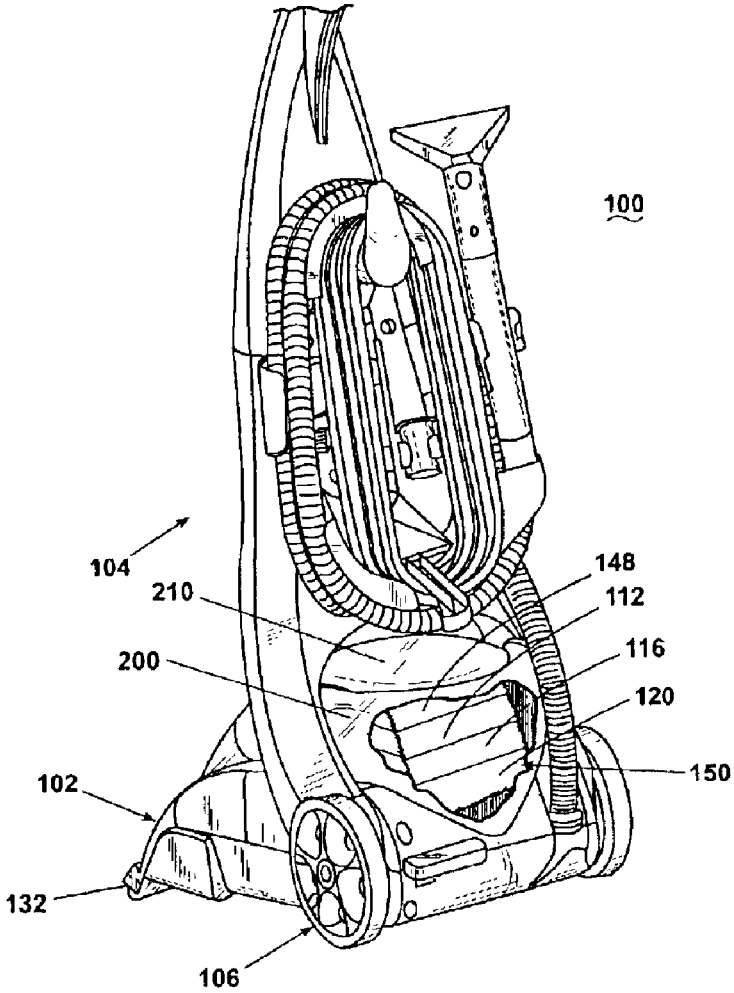
FIG. 3 is a partial cutaway rear perspective view of an upright extraction cleaning machine incorporating multiple flexible tanks into a base module according to the invention.

Referring now to FIG. 3, an upright extraction cleaning machine 100 has a floor traveling base module 102, an upright handle 104 pivotally mounted to the base module 102 and a pair of wheels 106 supporting the extraction cleaning machine 100. In this cutaway drawing, a solution dispensing/recovery tank assembly 150 includes a rigid housing 200 having a cover 210 with a pivotal handle 212, the housing 200 being carried by the base module 102.

The flexible tanks/bladders 112, 116, 120, 148 each have a substantially horizontal orientation so that they can be stacked one upon the other and carried within the rigid housing 200. In this arrangement, the recovery tank 148 presses down upon the other bladders as it fills with recovered liquid. It is also anticipated that the assembly 150 further comprises a weight or spring (not shown) bearing upon the solution dispensing tanks 112, 116, 120 to encourage their collapse upon dispensing their solution and to facilitate expansion of the uppermost bladder 148.

Figure 4:
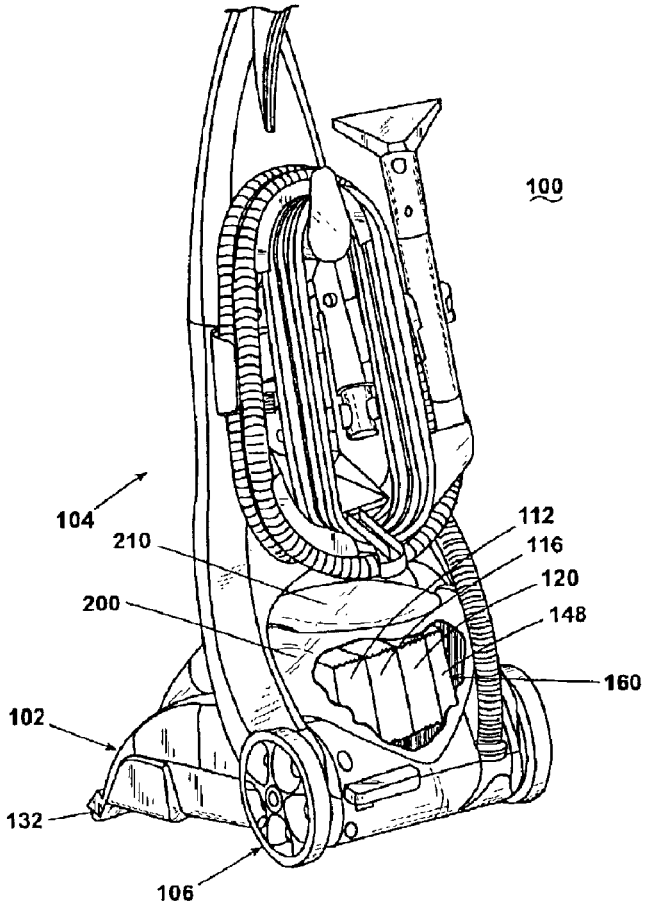
FIG. 4 is a partial cutaway rear perspective view of an upright extraction cleaning machine incorporating multiple flexible tanks into a base module according to another embodiment of the invention.

Referring now to FIG. 4 where like numerals have been used to describe like parts, a further embodiment of the upright extraction cleaning machine 100 has a solution dispensing/recovery tank assembly 160 including a rigid housing 200 on the base module 102. In FIG. 4, the housing 200 is partially cut away.

The assembly 160 further comprises flexible tanks/bladders 112, 116, 120, 148, each having a substantially vertical orientation and arranged side by side within rigid housing 200. The assembly 160 can include spring elements (not shown) bearing upon the solution dispensing bladders 112, 116, 120 to encourage their collapse upon dispensing the solution and to facilitate expansion of the recovery tank/bladder. For instance, the spring elements are biased against the bladders 112, 116, 120 away from bladder 148. It is also anticipated that air pressure developed by the suction source, particularly the exhaust of the suction source, can be directed into the housing 200 or the recovery bladder 148 to aid in expansion of the recovery bladder and/or collapse of the solution dispensing bladders. This pressure on the solution dispensing bladders by the spring elements can be sufficient to pressurize the cleaning solution so that it can flow to the dispensing nozzle 128 without the need for the pump 124. Thus, the pump 124 is optional in this embodiment.

Figure 5:
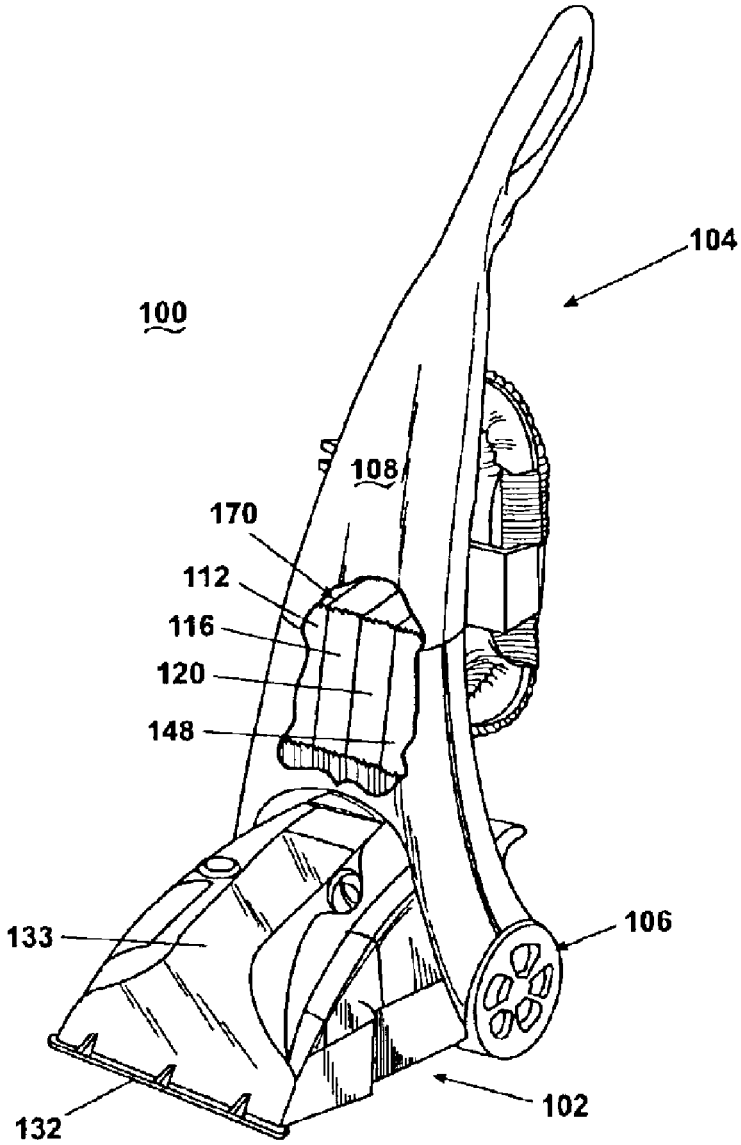
FIG. 5 is a partial cutaway perspective view of an upright extraction cleaning machine incorporating multiple flexible tanks into an upright handle according to another embodiment of the invention.

Referring now to FIG. 5, a solution dispensing/recovery tank assembly 170 is contained within a rigid housing 108 of the upright handle 104 of the upright extraction cleaning machine 100. The assembly 170 comprises a plurality of flexible tanks/bladders 112, 116, 120 and 148, each having a generally vertical orientation and aligned side by side within the upright handle 104 of the upright extraction cleaning machine 100, much in the fashion of the assembly 160 of FIG. 4. A portion of the housing 108 is broken away to show the arrangement of the bladders 112, 116, 120 148 in the housing 108.

Figure 6:
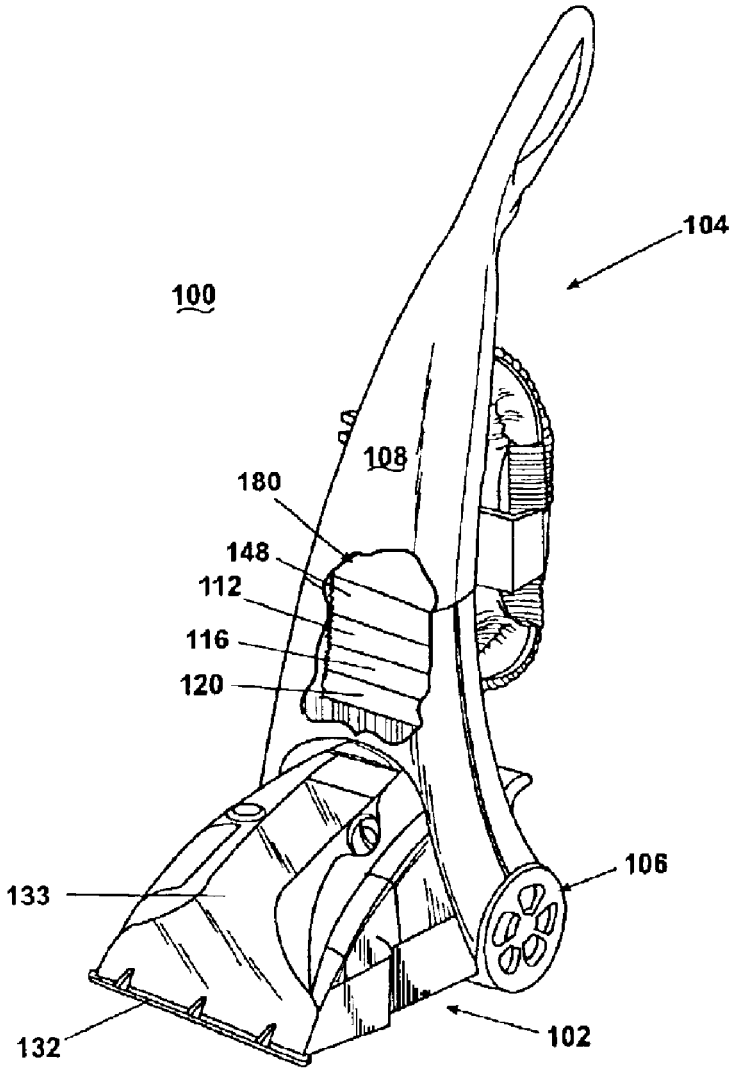
FIG. 6 is a partial cutaway perspective view of an upright extraction cleaning machine incorporating multiple flexible tanks into an upright handle according to another embodiment of the invention.
Figure 12:
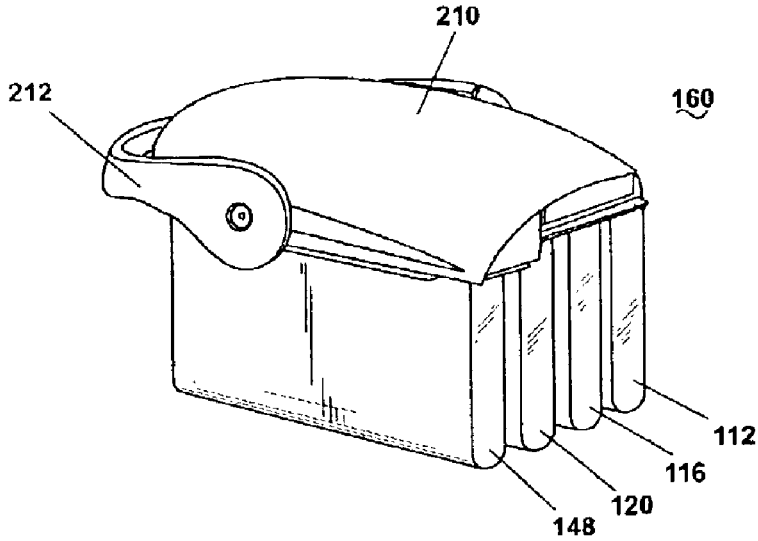
FIG. 12 is a perspective view of the flexible tank assembly shown in FIG. 4.
Figure 7:
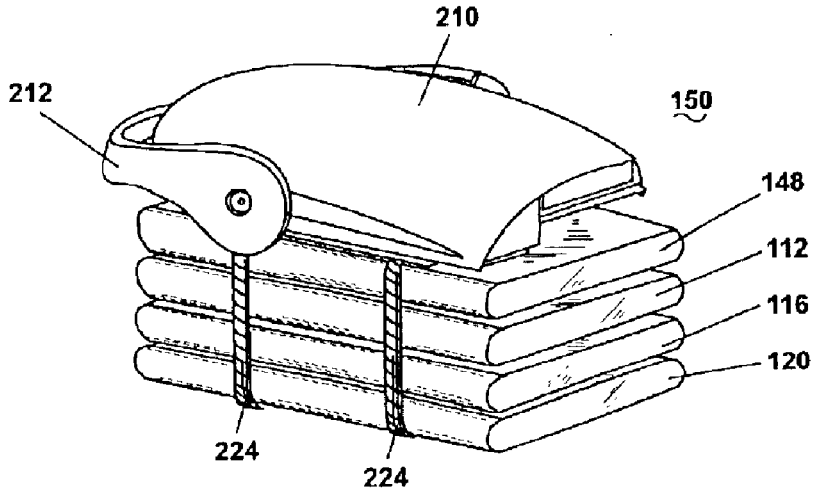
FIG. 7 is a perspective view of the flexible tank assembly shown in FIG. 3.
Figure 8:
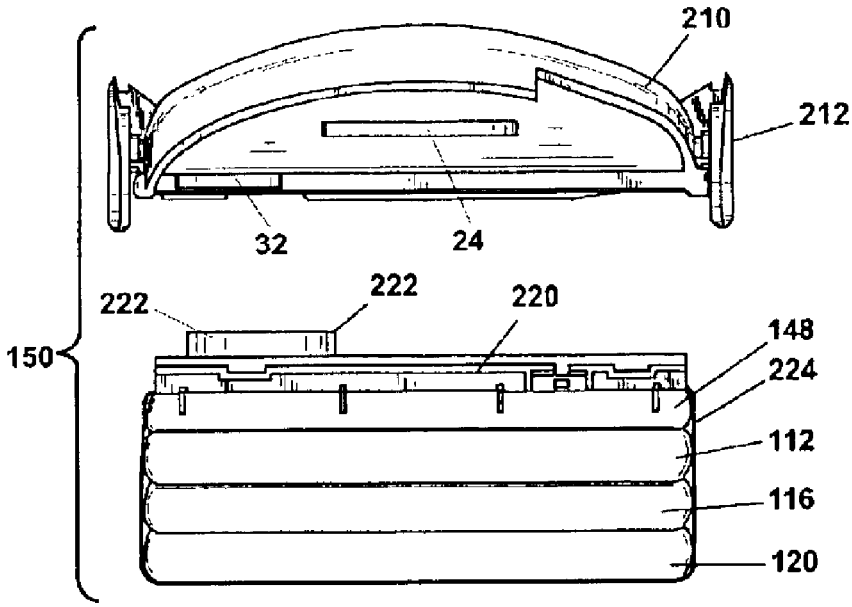
FIG. 8 is an exploded front view of the flexible tank assembly shown in FIG. 7.
Figure 9:
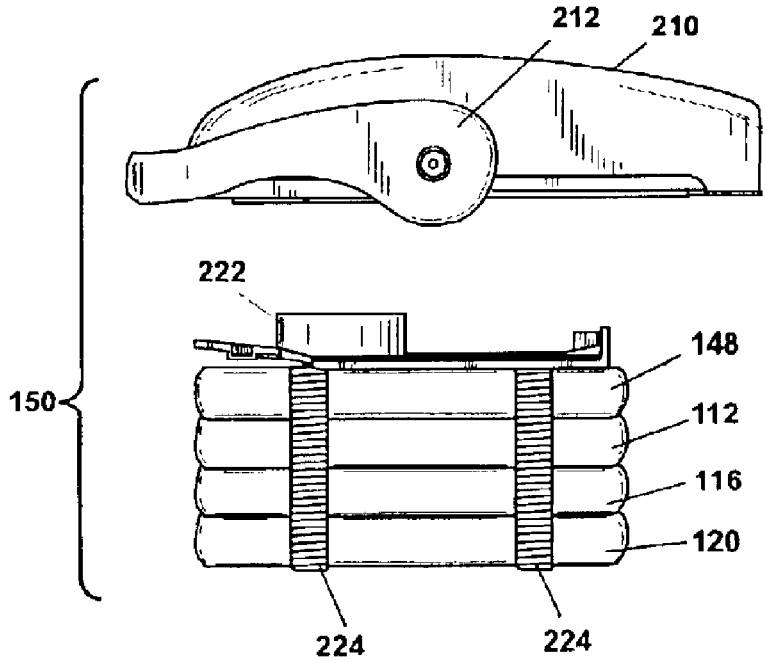
FIG. 9 is an exploded side view of the flexible tank assembly shown in FIGS. 7–8.

Referring to FIG. 6, a solution dispensing/recovery tank assembly 180 is contained within a rigid handle housing 108 of the upright handle 104 of the upright extraction cleaning machine 100. The assembly 180 comprises a plurality of flexible tanks/bladders 112, 116, 120 148 each having a generally horizontal orientation and stacked within the upright handle 104 of the upright extraction cleaning machine 100, much in the fashion of the assembly 150 of FIG. S. A portion of the housing 108 is broken away to show the arrangement of the bladders 112, 116, 120 and 148 in the housing 108.

In the embodiments illustrated in FIGS. 5 and 6, the cleaning fluid can flow from the flexible tanks/bladders 112, 116 and 120 by gravity to the dispensing nozzle 128 without the aid of a pump 124. The cleaning fluid can be pressurized to flow cleaning solution to the spray nozzle 128 by springs or air pressure as described above.

FIGS. 7–11 depict the solution dispensing/recovery tank assembly 150. In this embodiment, the flexible tanks/bladders 112, 116, 120 and 148 are suspended from a lid 210 of the rigid housing 200. A removable frame 220 carries the bladders 112, 116, 120 and 148 by a pair of retention straps 224. The frame 220 is removably mounted to the lid 210, and can include a filler neck 222 for fluidly connecting to the solution dispensing or recovery systems.

Each of the tanks 112, 116, 120 and 148 includes inlet openings and outlet ports for filling and emptying the tanks, respectively. The inlet openings of each solution dispensing tank 112, 116, 120 and 148 is for the user to fill the solution dispensing tank with the appropriate fluid. The outlet ports of the dispensing tanks are fluidly connected to the solution dispensing system. The inlet port of the recovery tank 148 is fluidly connected to the recovery system, while the outlet port is accessible for emptying the recovery tank by the user. An air/liquid separator 24 that can be, but need not be, the separator disclosed in U.S. Pat. No. 6,167,586 is mounted in the lid 210 for separation of the soiled liquid from air.

Figure 10:
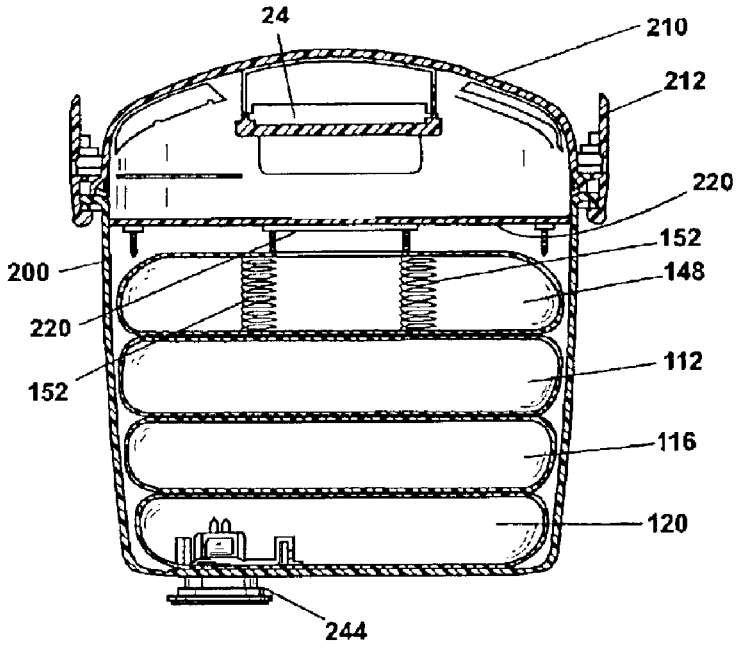
FIG. 10 is a cross-sectional view of the flexible tank assembly shown in FIGS. 7–9.
Figure 11:
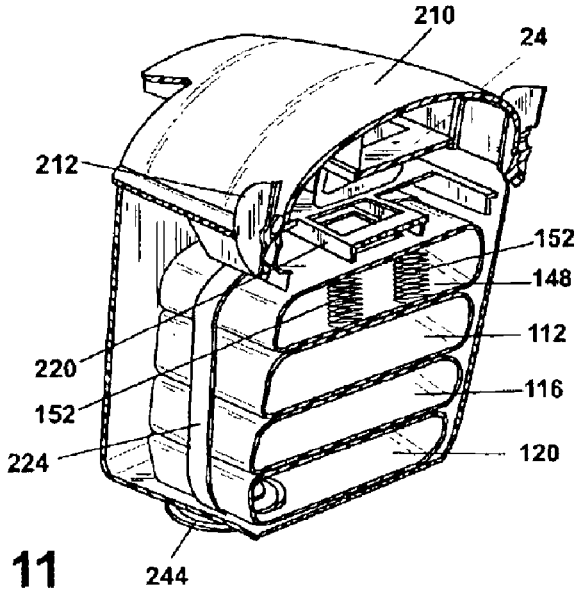
FIG. 11 is a perspective view in section of the flexible tank assembly shown in FIGS. 7–10.
Figure 13:
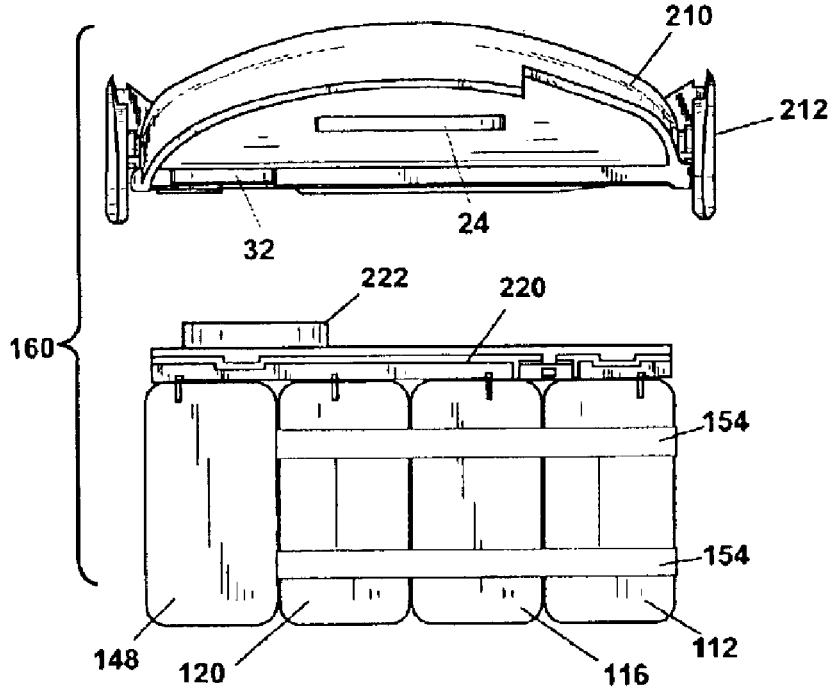
FIG. 13 is an exploded front view of the flexible tank assembly shown in FIG. 12.
Figure 14:
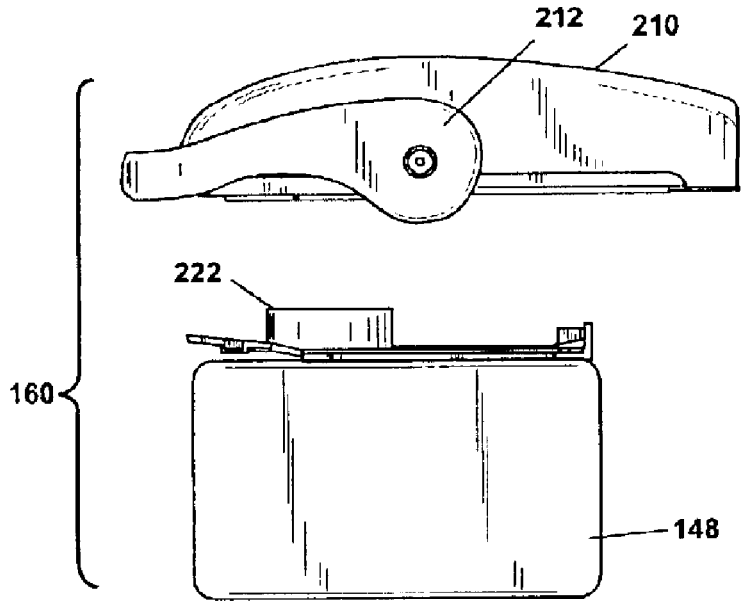
FIG. 14 is an exploded side view of the flexible tank assembly shown in FIGS. 12–13.

Referring to FIGS. 10–11, an exemplary outlet port 244 is disclosed for tank 120. Outlet port 244 is anticipated by way of example to be a self-closing valve that opens and fluidly connects to the dispensing system when the assembly 150 is inserted in the base module 102. A bladder having an inlet fill opening and a dispensing outlet port is disclosed in U.S. Pat. No. 6,230,362, incorporated herein by reference. Interior springs 152 are mounted with the recovery tank 148 to bias the recovery tank into an open position, and, at the same time, to bias the bladders 112, 116 and 120 into a collapsed position.

FIGS. 12–16 depict the solution dispensing/recovery tank assembly 160. In this anticipated embodiment, the flexible tanks/bladders 112, 116, 120 and 148 are suspended from the lid 210 of the rigid housing 200. The bladders 112, 116, 120 and 148 are suspended directly from the frame 220 which is removably mounted to the lid 210. A pair of elastic bands are stretched around the bladders 112, 116 and 120 to bias these bladders into a collapsed condition and thus pressurize the liquid in these bladders.

Figure 15:
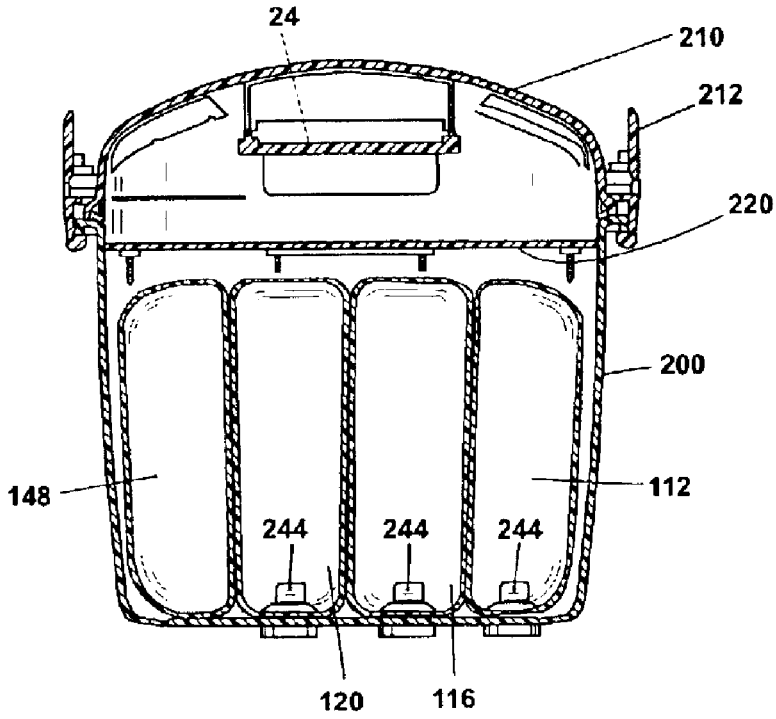
FIG. 15 is a cross-sectional view of the flexible tank assembly shown in FIGS. 12–14.
Figure 16:
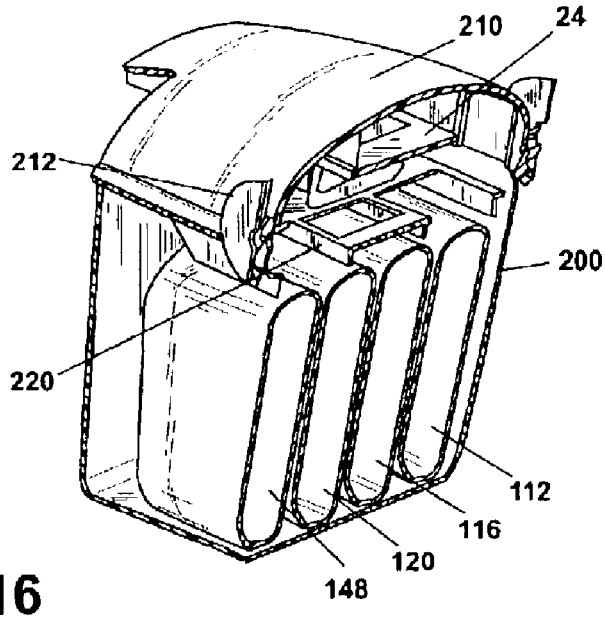
FIG. 16 is a perspective view in section of the flexible tank assembly shown in FIGS. 12–15.

Each of the tanks 112, 116, 120 and 148 includes inlet openings and outlet ports (not shown) for filling and emptying the tanks respectively. The inlet openings of each solution dispensing tank enable the user to fill the solution dispensing tank with the appropriate fluid. The outlet ports of the dispensing tanks are fluidly connected to the solution dispensing system. The inlet opening of the recovery tank 148 is fluidly connected to the recovery system, while the outlet port is accessible for emptying the recovery tank 148 by the user. Referring to FIGS. 15–16, outlet ports 244 in bladders 112, 116 and 120 function as described above with reference to FIGS. 10–11 and as described in U.S. Pat. Nos. 6,230,362 and 6,167,586 which are incorporated herein by reference.

In the various embodiments depicted in FIGS. 1–15, the solution dispensing tanks and recovery tank are all located in a single housing, whether it be on the base module or the upright handle of the upright extraction cleaner. It is further anticipated that one or more of the tanks can be located remotely from the remaining tanks. For example, one or more tanks can be located in the upright handle while the remaining tanks are located in the base module.

In a preferred embodiment, each of the flexible bladder assemblies previously described is in communication with a socket formed in the portable upright extraction cleaning unit. A plurality of receivers corresponding to the fittings on outlet openings of the flexible bladders are located along the bottom wall of the socket. In operation, the flexible bladder assembly is lifted by the operator such as by the handle 212 and carried to a convenient workspace where the bladders are filled with desired liquids, cleaning agents, or upholstery protectants through respective fill openings in each flexible bladder. The recovery tank can also be emptied at this time. Once filled, the flexible bladder assembly is carried by the handle 212 and placed in the socket area of the upright extraction cleaner so that the fittings on the outlet openings correspond with and communicate with receivers in the extraction cleaner to fluidly connect the tanks with a respective dispensing or recovery system in the same manner as described in U.S. Pat. No. 6,167,586.

Although the invention has been described with respect to an upright extractor in which a handle is pivotally mounted to a base, the invention is equally applicable to other types of extractors, including hand held extractors and canister extractors, the later of which is disclosed, for example, in U.S. Pat. No. 5,735,017.

While the invention has been specifically described in connection with certain specific embodiments thereof, it is to be understood that this is by way of illustration and not of limitation. Reasonable variation and modification are possible within the scope of the forgoing description of the drawings and the specification without departing from the spirit of the invention, which is defined in the accompanying claims.

What is claimed is:

1. An extraction cleaning machine comprising:

a housing;

a cleaning solution dispensing system mounted to the housing and including:

a cleaning solution tank for holding a liquid cleaner to be applied to a surface to be cleaned;

a fluid dispenser for dispensing the liquid cleaner onto a surface to be cleaned; and a liquid cleaner conduit between the cleaning solution tank and the fluid dispenser for passing liquid from the cleaning solution tank to the fluid dispenser;

a fluid recovery system mounted to the housing for recovering expended cleaning solution from the surface to be cleaned and including:

a suction nozzle associated with the housing for retrieving soiled liquid from the surface to be cleaned;

a recovery tank for collecting recovered soiled liquid;

a working air conduit in fluid communication with the suction nozzle and the recovery tank; and a suction source in communication with the suction nozzle, the working air conduit and the recovery tank for withdrawing a liquid and air mixture from the surface to be cleaned through the suction nozzle and the working air conduit and depositing soiled liquid in the recovery tank;

the improvement which comprises:

the cleaning solution tank and the recovery tank both comprise a flexible membrane whereby the recovery tank can expand as recovered fluid is received therein and the cleaning solution tank can collapse as the cleaning fluid is dispensed therefrom; and wherein the dispensing tank and the recovery tank are adjacent to one another in a common space and positioned so that the dispensing tank collapses as the recovery tank expands.

2. An extraction cleaning machine according to claim 1 wherein the cleaning solution dispensing system further comprises at least additional tank for an additional liquid, an additive conduit between the at least one additional tank and the liquid cleaner conduit for adding liquid from the additional tank to the cleaning solution.

3. An extraction cleaning machine according to claim 2 wherein the at least one or each additional tank in the dispensing system each comprises a flexible membrane that collapses as liquid therein is dispensed therefrom.

4. An extraction cleaning machine according to claim 3 wherein all of the tanks are mounted in a confined shell in the housing wherein the volume occupied by the tanks remains substantially constant during use of the cleaning machine.

5. An extraction cleaning machine according to claim 4 wherein the housing comprises a base module adapted to move along a surface to be cleaned and a handle pivotally mounted to the base module, and wherein all of tanks are mounted to the base module.

6. An extraction cleaning machine according to claim 5 wherein the tanks are arranged in side by side horizontal alignment in the base module.

7. An extraction cleaning machine according to claim 5 wherein the tanks are arranged in vertically stacked alignment in the base module.

8. An extraction cleaning machine according to claim 4 wherein the recovery tank is biased into an expanded condition.

9. An extraction cleaning machine according to claim 4 wherein the housing comprises a base module adapted to move along the surface to be cleaned and a handle is pivotally mounted to the base module, and wherein all of the tanks are mounted on the upright handle.

10. An extraction cleaning machine according to claim 9 wherein the tanks are arranged in side by side alignment in the base module.

11. An extraction cleaning machine according to claim 9 wherein the tanks are arranged in vertically stacked alignment in the base module.

12. An extraction cleaning machine according to claim 4 wherein the recovery tank is biased into an expanded condition.

13. An extraction cleaning machine according to claim 12 wherein the recovery tank itself has a natural bias to the expanded condition and in the tank is biased into the expanded condition by the resilient nature of the recovery tank.

14. An extraction cleaning machine according to claim 12 wherein the recovery tank has interior springs that bias the recovery tank to the expanded position.

15. An extraction cleaning machine according to claim 12 wherein the vacuum source is downstream of the recovery tank to draw the air and water mixture into the recovery tank.

16. An extraction cleaning machine according to claim 12 wherein the each or at least one cleaning solution tank is biased to a collapsed condition.

17. An extraction cleaning machine according to claim 2 and further comprising an adjustable valve for adjusting the relative proportions of additional liquid and liquid cleaner dispensed onto the surface to be cleaned by the fluid dispenser.

18. An extraction cleaning machine according to claim 1 further comprising an air/water separator removably mounted to the housing and connected to the working air conduit and to the recovery tank, and the recovery tank is mounted to the air/water separator.

19. An extraction cleaning machine according to claim 18 wherein the cleaning solution tank is also mounted to the air/water separator.

20. An extraction cleaning machine according to claim 19 wherein the cleaning solution tank and the recovery tank are mounted to the air/water separator in horizontally juxtaposed orientation and secured to the air/water separator with inextensible straps to confine the cleaning solution tank and the recovery tank to a fixed space.

21. An extraction cleaning machine according to claim 19 wherein the cleaning solution tank and the recovery tank are mounted to the air/liquid separator in vertical orientation.

22. An extraction cleaning machine according to claim 1 wherein all the tanks are mounted in a confined shell in the housing wherein the volume occupied by the tanks remain substantially constant during the use of the cleaning machine.

23. An extraction cleaning machine according to claim 22 wherein the housing comprises a base module adapted to move along a surface to be cleaned and a handle pivotally mounted to the base module, and where all of the tanks are mounted on the base module.

24. An extraction cleaning machine according to claim 23 wherein the tanks are arranged in side by side alignment in the base module.

25. An extraction cleaning machine according to claim 23 wherein the tanks are arranged in vertically stacked alignment in the base module.

26. An extraction cleaning machine according to claim 22 when the recovery tank is biased into an expanded condition.

27. An extraction cleaning machine according to claim 22 wherein the housing comprises a base module adapted to move along a surface to be cleaned and a handle pivotally mounted to the base module, and wherein all of the tanks are mounted on the upright handle.

28. An extraction cleaning machine according to claim 27 wherein the tanks are arranged in side by side alignment in the base module.

29. An extraction cleaning machine according to claim 27 wherein the tanks are arranged in vertically stacked alignment in the base module.

30. An extraction cleaning machine according to claim 1 wherein the recovery tank is biased into an expanded condition.

31. An extraction cleaning machine according to claim 30 wherein the recovery tank itself has a natural bias to the expanded condition and the recovery tank is biased into the expanded condition by the resilient nature of the recovery tank.

32. An extraction cleaning machine according to claim 30 wherein the recovery tank has interior springs that bias the recovery tank to the expanded position.

33. An extraction cleaning machine according to claim 30 wherein the vacuum source is downstream of the recovery tank to draw the air and water mixture into the recovery tank.

34. An extraction cleaning machine according to claim 30 wherein the solution tank is biased to a collapsed condition.

* * * * *